US006247192B1

(12) United States Patent
Bostoen

(10) Patent No.: US 6,247,192 B1
(45) Date of Patent: Jun. 19, 2001

(54) ECONOMIZER DEVICE FOR TOILET TANK

(76) Inventor: Rita Bostoen, Rue du Dronckaert 15, B-8930 Menem (BE)

( * ) Notice: Subject to any disclaimer, the term of this patent is extended or adjusted under 35 U.S.C. 154(b) by 0 days.

(21) Appl. No.: 09/581,860

(22) PCT Filed: Dec. 29, 1998

(86) PCT No.: PCT/IB98/02123

§ 371 Date: Aug. 9, 2000

§ 102(e) Date: Aug. 9, 2000

(87) PCT Pub. No.: WO99/34066

PCT Pub. Date: Jul. 8, 1999

(30) Foreign Application Priority Data

Dec. 29, 1997 (EP) ..... 97122932

(51) Int. Cl.[7] ..... E03D 1/00
(52) U.S. Cl. ..... 4/415; 220/23.6
(58) Field of Search ..... 4/415; 220/23.6, 220/501, 603; 206/509, 511; 47/83

(56) References Cited

U.S. PATENT DOCUMENTS

| | | | | |
|---|---|---|---|---|
| 3,982,282 | | 9/1976 | Kong | 4/1 |
| 4,057,931 | * | 11/1977 | Stutelberg et al. | 220/23.6 X |
| 4,121,308 | * | 10/1978 | Raab | 4/415 |
| 4,128,906 | | 12/1978 | Raz | 4/325 |
| 4,151,680 | * | 5/1979 | Sena | 47/83 X |
| 4,178,644 | * | 12/1979 | Zarlengo | 4/415 X |
| 5,469,655 | * | 11/1995 | Lin | 47/83 |

FOREIGN PATENT DOCUMENTS

| | | |
|---|---|---|
| 87003058 | 10/1987 | (DE) . |
| 2683562 | 5/1993 | (FR) . |
| 2249325 | 5/1992 | (GB) . |
| 2276861 | 10/1994 | (GB) . |

* cited by examiner

*Primary Examiner*—Charles E. Phillips
(74) *Attorney, Agent, or Firm*—Ladas & Parry

(57) ABSTRACT

The invention concerns an economiser device for toilet tank comprising a plurality of stacked and ballasted base units (1), said base units (1) including a substantially prismatic hollow shape having, in operative position, an open top surface, the lateral surfaces of said base unit (1) comprising interlocking means (7, 8, 9) for co-operating to make said units (1) mutually integral, whereof the width and the length is a multiple of a modular value M.

16 Claims, 2 Drawing Sheets

ECONOMIZER DEVICE FOR TOILET TANK

FIELD OF THE INVENTION

The invention relates to devices intended to reduce consumption in WC flush apparatuses.

One of the acute problems in the world at present is the reduction in potable water reserves and, in parallel with this, the treatment of the water used.

Although more and more industries and individuals have become aware of this state of affairs, initiatives in this area are hampered by the age of equipment and installations.

BACKGROUND OF THE INVENTION

Toilets which use conventional water flush apparatuses are a typical example of waste, the quantity of water used to obtain effective flushing of the bowl often being disproportionate to the actual needs of the users.

A certain number of manufacturers have therefore included in their range double-release water flush apparatuses which allow the user to employ a partial or a complete cistern. In order to market effective water flush apparatuses, the manufacturer is obviously obliged to provide a maximalist solution which ensures an effective result whatever the conditions of use.

It is therefore difficult if not impossible to adapt each WC to the individual requirements of each household. Moreover, the dual control is seldom easy or obvious in its operation. The only real possibility of control left to the user is that of controlling the maximum level of the cistern, something which is possible only to a relatively small extent. Moreover, once the level of the water has dropped, the centre of gravity of the mass of water is displaced downwards, resulting in a reduction in the potential energy accumulated in the cistern and a consequent loss of efficiency.

DESCRIPTION OF THE PRIOR ART

Various devices have been developed to reduce the volume of water by reducing the volume of the cistern proper.

Mechanical systems such as those developed, for example, in U.S. Pat. No. 4,128,906 often have the disadvantage of a lack of universality: they can only be adapted to a limited number of cisterns and they are found to be susceptible to chalky deposits.

Numerous devices are based on the use of flexible plastic receptacles or pockets which hug the shape of the internal wall of the cistern to a greater or lesser extent. During use, the performance of these devices is found to be poor since ultimately they hinder the proper functioning of the mechanism for replenishing or releasing the water. Among these devices, attention may be drawn in particular to those described in FR 2 683 562 and GB-2 276 861, GB-2 249 325.

Other systems amount to the introduction into the cistern of heavy volumes (cast iron, brick, . . . ) or complex structures (U.S. Pat. No. 3,982,282), which are awkward to position because of their weight and their generally rather unsuitable shape.

The function of these devices should, of course, not be confused with that of dispensers for aromatic or disinfectant products which are to be hung in cisterns, as described in DE-U-8700305. This hanging dispenser, which is closed by a cover, comprises a chamber containing ballast and a chamber enclosing a disinfectant or aromatic product of controlled solubility in water.

BRIEF DESCRIPTION OF THE INVENTION

An attempt has therefore been made to develop a system which is both effective and easy to implement.

One object of the invention is to market a device which is easy to install and can be adapted to almost all flush cisterns, wherever they come from and whoever the manufacturer.

It is another object of the invention that this device should be highly stable over time and is at no risk of being displaced in the cistern.

Another object is that it should be possible for the device to be installed by a person with few mechanical skills.

The invention relates to a water economizer device for a water flush system, which is comprised of a plurality of stackable, ballasted base units, each of these base units having

- a substantially prismatic hollow shape for storing a volume of water with a vertical axis with, in an operative position, an open top face,
- lateral faces, these having nesting members capable of cooperating so as to join these base units together, the breadth and length of these units being a multiple of a modular value M, at least one calibrated opening being provided in the base of each of these units in such a way as to allow part of the stored volume to flow out in such a way as to ensure a flow of water which avoids stagnation.

This device is preferably constructed from a rigid moulded material such as a polymeric material selected, in particular, from the polyamides, the polypropylenes and the polystyrenes.

The prismatic shape is preferably a parallelepiped. According to another preferred form, it is a prism with a hexagonal or octahedral base.

The base units are advantageously ballasted at the level of the bottom face of the unit.

The nesting members advantageously comprise intentations and tenons and/or bosses which project relative to the bottom face of each base unit.

Outlet channels are preferably provided near to the upper edge of the lateral walls.

If the nesting members comprise bosses, intentations and tenons, the outlet channels advantageously correspond to the relative difference in height between these intentations and the tenons.

The device can comprise means capable of fixing at least one base unit to a fixed element of a water flush cistern.

The fundamental principle of the device according to the invention is to replace part of the volume of water in a flush cistern with a "captive" volume which flows out slowly, such that it is virtually only the volume of water outside the device according to the invention which is emptied towards the bowl when the flush apparatus is actuated.

According to an advantageous embodiment, the ballast of certain of these nestable units includes a magnetized material so as to prevent the formation of chalky deposits.

BRIEF DESCRIPTION OF THE DRAWINGS

Other details and advantages of the invention will emerge from the following description of a particular embodiment, reference being made to the attached drawing, in which.

DETAILED DESCRIPTION OF THE DRAWINGS

The device is made up of a plurality of base units 1. In FIGS. 1 to 5, each of these units 1 takes the form of a hollow parallelepiped open at its top face.

The bottom face 2, which is intended to face towards the bottom of a water flush cistern has cavities 3 for the introduction of a ballast material 4.

Figure 2:
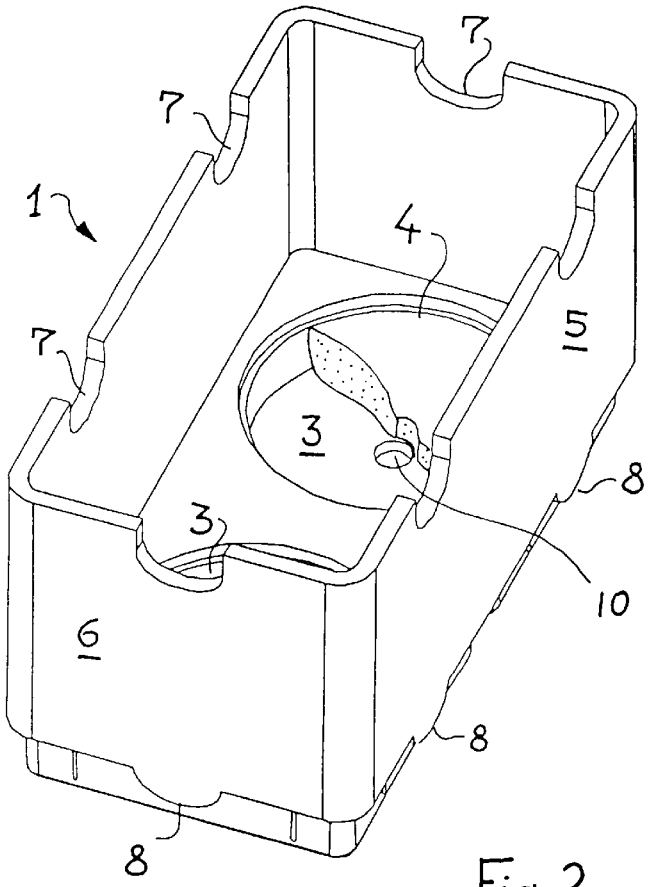
FIG. 2 is another perspective view of the unit in FIG. 1, with part broken away.

FIG. 2 shows one such cavity 3, which is open and not filled, but it is obvious that a cavity 3 of this kind can be closed with the material for ballasting 4 being fully enclosed within the cavity 3.

The base unit 1 has bosses 9 which project relative to its bottom face 2 and, near to the top and bottom edges of its lateral faces 5, 6, has nesting means 7, 8 which, in the figure shown, take the form of intentations 7 and tenons 8.

The tenons 8 are arranged on the flanks of the bosses 9.

The dimensions of the bosses 9, of the tenons 8 and the intentations 7 make it possible to insert a base unit 1 precisely in the top part of another unit 1, thus ensuring that the base units 1 are joined together in an effective manner.

Figure 1:
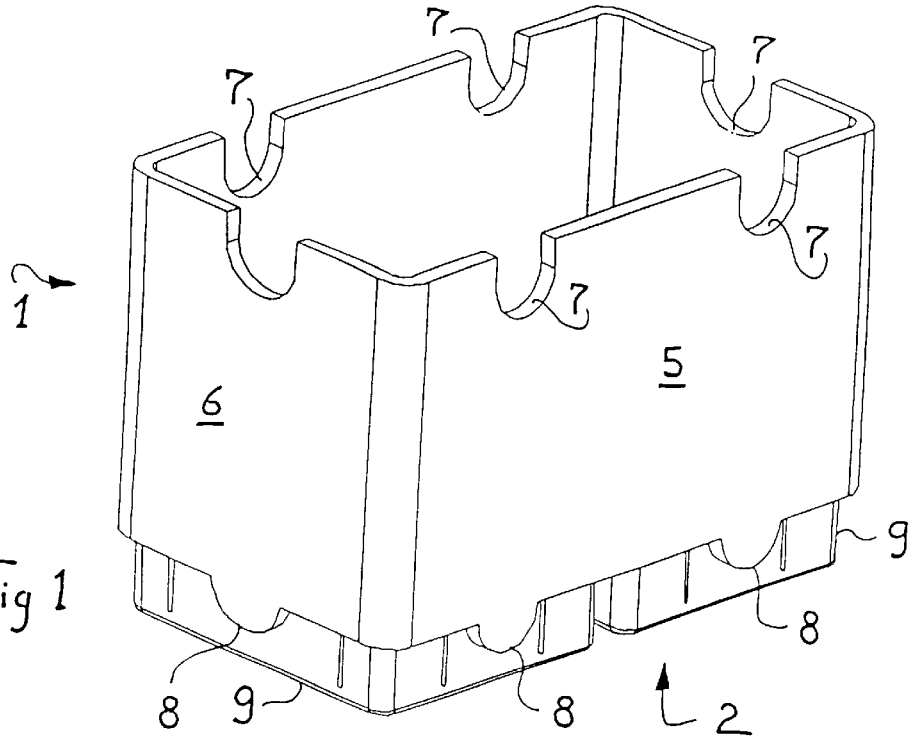
FIG. 1 is a perspective view of one of the units forming the device.

The base of each base unit has at least one opening 10. These openings 10 are situated at any point on the base and, in particular, can pass through the cavities 3, as shown in FIG. 1.

These openings 10 play a not insignificant part in the use of the device according to the invention.

In fact, the user can assemble the base units 1 with the cistern either full or empty, as seems most practical.

If the cistern is full, the presence of the openings 10 allows each unit 1 to sink under the effect of its own weight without the need to overcome the effect of buoyancy and come to rest on the bottom of the cistern or fit onto another element.

The length and breadth of the base units 1 are determined in multiples of a modular value M. The elements shown in FIGS. 1 and 2 thus have a breadth M and a length 2M, allowing two modules to be stacked either directly, in an offset manner or in a crossed manner as desired, as shown respectively in FIGS. 3, 4 and 5.

Figure 6:
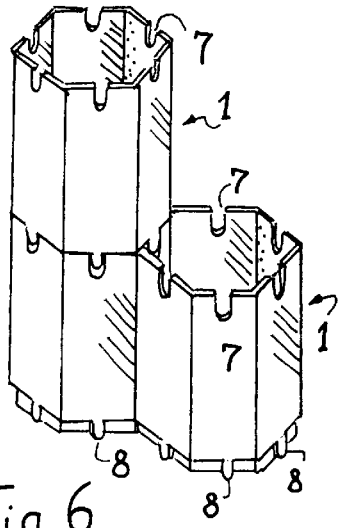
FIG. 6 is a perspective view of another embodiment of the invention.
Figure 4:
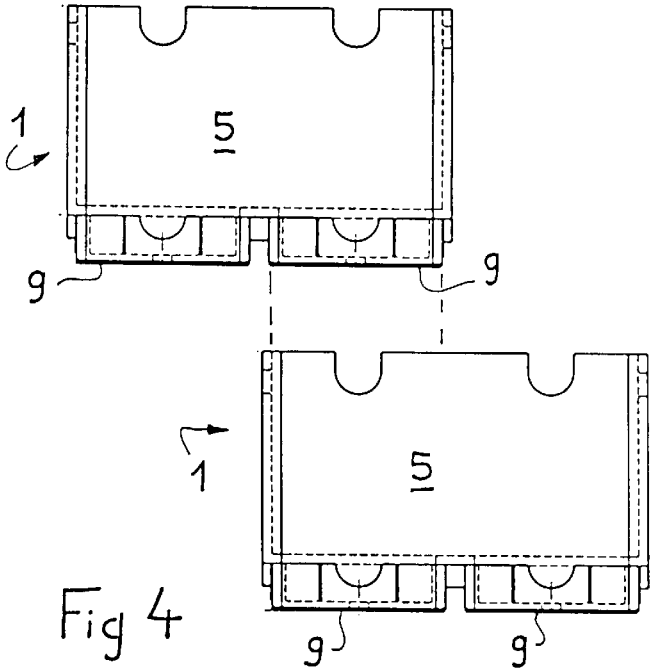
FIGS. 3, 4 and 5 show various ways in which the base units forming the device can be assembled, in side view
Figure 5:
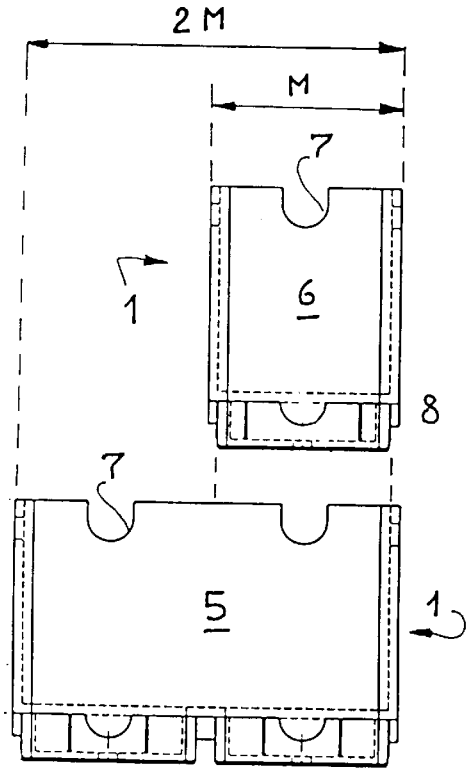
Figure 3:
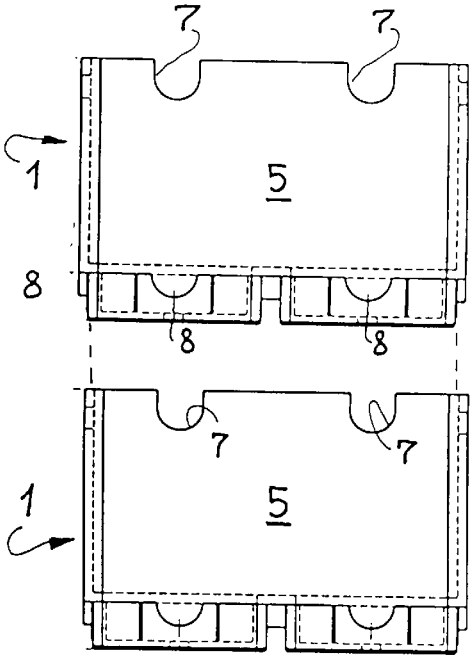

It will be noted that, in addition to the parallelepipedic form shown in FIGS. 1 to 5, it is possible to use other modular shapes with a vertical axis, such as prisms, in particular those with a hexagonal or octahedral base (see FIG. 6).

Consequently, it is possible to arrange in virtually any of the water flush cisterns available on the market a structure formed by joined base units 1 capable of storing a volume of water available on demand and doing this without impairing the operation of the mechanisms contained in these cisterns.

The intentations 7 and the tenons 8 in combination with the bosses 9 allow effective assembly with a minimum loss of space without producing fluid compression in a closed volume.

It will be observed that the depth of the intentations 7 is slightly greater than the height of the tenons 8. There are thus outlet channels between two superposed base units.

When the water flush apparatus is actuated, a certain proportion of the volume of water stored in each base unit escapes via the opening or openings 10 and flows along the lateral walls 5, 6 via the base of the intentations 7, avoiding stagnation of the volume of water stored and, consequently, the formation of algae and mould.

It will be appreciated that the bosses 9, which are shown here in a square form can, in particular, take an octahedral form. The base units 1 according to the invention can thus take the form of bevelled parallepipeds, this, in combination with the above-described form of the bosses 9, allowing assembly at 45°.

It is likewise possible to use base elements of a length equal to 3M or more. Finally, small bars having fixing means adapted in shape, in particular, to the intentations 7 make it possible to join one or more stacks of units 1 to the wall of the cistern.

The dimensions of the base units 1 are chosen to allow the device to be adapted easily to the majority of flush cisterns available on the market without altering the operation of the various mechanisms present in these cisterns. However, practical tests indicate that excellent results are obtained with a water capacity of 0.25 to 0.3 litres per base unit.

Since the base units are extremely simple to assemble and disassemble, the user can decide him or herself by means of a few tests the number of units corresponding to the optimum to be used, and the saving of water can be as much as 30%.

The ballast 4 placed in the units can be formed by various materials. In particular, it is possible to use a material with magnetic properties, the presence of a magnetic field within the mass of water preventing the formation of chalky deposits. Depending on the configuration, it may not be necessary for all the base units 1 used to form an assembly comprising magnetic masses.

What is claimed is:

1. A water economizer device for a water tank of a flush system, the water economizer device comprising stackable, ballasted base units, each of the base units having, externally, lateral faces substantially prismatic and, internally, a hollow shape for storing a volume of water with, in an operative position, an open top face, the lateral faces having nesting members capable of cooperating so as to join the base units together, breadths and lengths of the base units being at least one integer multiple of a modular value M, and at least one calibrated opening being provided in a base in the operative position of each of the base units in such a way as to allow part of the stored volume of water to flow out of the hollow shave.

2. A device according to claim 1, which is constructed using a rigid moulded material.

3. A device according to claim 2, wherein this material is a polymeric material.

4. A device according to claim 3, wherein the prismatic shape is a parallelepiped.

5. A device according to claim 1, wherein the prismatic shape is a parallelepiped.

6. A device according to claim 5, wherein the nesting members comprise intentations and tenons.

7. A device according to claim 5, wherein the nesting members comprise bosses which project relative to the bottom face of each base unit.

8. A device according to claim 1, wherein the nesting members comprise intentations and tenons.

9. A device according to claim 7, wherein outlet channels are provided near to the upper edge of the lateral walls.

10. A device according to claim 9, wherein, with the nesting means being intentations and tenons, the outlet channels correspond to a relative difference in height between these intentations and the tenons.

11. A device according to claim 10, which further comprises joining means capable of fixing at least one base unit to a fixed element of a water flush cistern.

12. A device according to claim 11, wherein at least one base unit includes a magnetized ballasting material.

13. A device according to claim 1, wherein the nesting members comprise bosses which project relative to the bottom face of each base unit.

14. A device according to claim 1, wherein outlet channels are provided near to the upper edge of the lateral walls.

15. A device according to claim 11, which further comprises joining means capable of fixing at least one base unit to a fixed element of a water flush cistern.

16. A device according to claim 1, wherein at least one base unit includes a magnetized ballasting material.

* * * * *